US011045920B2

(12) United States Patent
Okubo et al.

(10) Patent No.: US 11,045,920 B2
(45) Date of Patent: Jun. 29, 2021

(54) MACHINING APPARATUS

(71) Applicant: JTEKT CORPORATION, Osaka (JP)

(72) Inventors: Hirokazu Okubo, Habikino (JP); Atsushi Kuno, Obu (JP); Kenichiro Kitamura, Kashiba (JP)

(73) Assignee: JTEKT CORPORATION, Osaka (JP)

( * ) Notice: Subject to any disclaimer, the term of this patent is extended or adjusted under 35 U.S.C. 154(b) by 214 days.

(21) Appl. No.: 15/899,820

(22) Filed: Feb. 20, 2018

(65) Prior Publication Data

US 2018/0250790 A1 Sep. 6, 2018

(30) Foreign Application Priority Data

Mar. 1, 2017 (JP) ..... JP2017-038488

(51) Int. Cl.

| | |
|---|---|
| ***B24B 41/00*** | (2006.01) |
| ***B24B 41/06*** | (2012.01) |
| ***B24B 27/04*** | (2006.01) |
| ***B24B 27/00*** | (2006.01) |
| ***B24D 5/02*** | (2006.01) |

(52) U.S. Cl.

CPC ..... *B24B 27/0084* (2013.01); *B24B 27/003* (2013.01); *B24B 27/04* (2013.01); *B24B 41/002* (2013.01); *B24B 41/06* (2013.01); *B24B 41/067* (2013.01); *B24D 5/02* (2013.01)

(58) Field of Classification Search

CPC ... B24B 27/0084; B24B 27/00; B24B 41/002; B24B 41/00; B24B 27/003; B24B 27/0015; B24B 27/04

USPC ..... 451/49, 231, 5, 8–10, 42, 215, 216, 236

See application file for complete search history.

(56) References Cited

U.S. PATENT DOCUMENTS

| | | | | |
|---|---|---|---|---|
| 1,901,181 A * | 3/1933 | McCabe | ..... | B24B 13/043 451/159 |
| 2,556,604 A * | 6/1951 | Suddarth | ..... | B24B 13/043 451/159 |
| 3,449,865 A * | 6/1969 | Suddarth | ..... | B24B 13/043 451/159 |
| 3,803,767 A * | 4/1974 | Kotov | ..... | B23F 3/00 451/121 |

(Continued)

FOREIGN PATENT DOCUMENTS

| | | |
|---|---|---|
| JP | S58-077438 A | 5/1983 |
| JP | 2003-300133 A | 10/2003 |

(Continued)

OTHER PUBLICATIONS

Apr. 6, 2021 Office Action issued in Japanese Patent Application No. 2017-038488.

*Primary Examiner* — Eileen P Morgan
(74) *Attorney, Agent, or Firm* — Oliff PLC

(57) ABSTRACT

A machining apparatus machines an end face of a tapered roller with a grinding wheel. The machining apparatus includes a support mechanism configured to support the tapered roller, a wheel unit on which the grinding wheel is mounted, and a base configured to support the wheel unit so that the wheel unit is swivelable about a center line in a vertical direction. A machining point where the grinding wheel is brought into contact with the end face of the tapered roller supported by the support mechanism is located on an extension of the center line serving as a swivel center of the wheel unit.

5 Claims, 8 Drawing Sheets

(56) References Cited

U.S. PATENT DOCUMENTS

| | | | | |
|---|---|---|---|---|
| 4,419,846 | A * | 12/1983 | Schimitzek | B24B 13/043 451/159 |
| 4,535,566 | A * | 8/1985 | Soper | B24B 13/043 451/277 |
| 4,584,795 | A * | 4/1986 | Akabane | G05B 19/4166 451/21 |
| 6,224,462 | B1 * | 5/2001 | Yokoyama | B24B 5/00 451/10 |
| 2003/0236058 | A1 | 12/2003 | Kamamura et al. | |
| 2015/0111479 | A1 * | 4/2015 | Barensteiner | B23Q 1/017 451/143 |
| 2016/0193710 | A1 * | 7/2016 | Hagiwara | B24D 7/10 451/28 |

FOREIGN PATENT DOCUMENTS

| | | | |
|---|---|---|---|
| JP | 2005-279903 | A | 10/2005 |
| JP | 2015-196232 | A | 11/2015 |

* cited by examiner

MACHINING APPARATUS

INCORPORATION BY REFERENCE

The disclosure of Japanese Patent Application No. 2017-038488 filed on Mar. 1, 2017 including the specification, drawings and abstract, is incorporated herein by reference in its entirety.

BACKGROUND OF THE INVENTION

1. Field of the Invention

The present invention relates to an apparatus configured to machine a workpiece with a grinding wheel.

2. Description of the Related Art

In the process of manufacturing, for example, a tapered roller to be used as a rolling element of a tapered roller bearing, the tapered roller is shaped by grinding, and then its end face (end face having a larger diameter) is finished. For example, Japanese Patent Application Publication No. 2003-300133 (JP 2003-300133 A) discloses an apparatus configured to perform the machining described above. In this machining apparatus, a rotating grinding wheel is brought into contact with the end face of the tapered roller supported by rolls.

FIG. 6 is a perspective view illustrating a part of a related-art machining apparatus configured to finish an end face 98 of a tapered roller 99. The machining apparatus includes a support mechanism (not illustrated; for example, the rolls) and a wheel unit 90. The support mechanism supports the tapered roller 99. A grinding wheel 91 is mounted on the wheel unit 90. The grinding wheel 91 rotates about a center line Ca in a horizontal direction by a motor 92. The Wheel unit 90 is provided on a base 94 of the machining apparatus, and is swivelable (see FIG. 7) about a center line C0 in a vertical direction, which is located at a central part of the wheel unit 90. The center line C0 in the vertical direction is hereinafter referred to as a swivel center line C0.

In the apparatus configured to finish the end face 98 of the tapered roller 99, the tapered roller 99 is supported while being positioned. Therefore, the tapered roller 99 (end face 98) is set as a reference of machining. Thus, the position of the wheel unit 90 (grinding wheel 91) needs to be adjusted to the tapered roller 99. As illustrated in FIG. 6, the wheel unit 90 includes an upper unit 96 and a lower unit 97 for positional adjustment in a fore-and-aft direction. The grinding wheel 91 and the motor 92 are mounted on the upper unit 96, and a dovetail groove 96*a* whose groove direction is the fore-and-aft direction is formed in the upper unit 96. The lower unit 97 has a protruding bar 97*a* fitted to the dovetail groove 96*a*. The wheel unit 90 includes a mechanism configured to move the upper unit 96 in the fore-and-aft direction relative to the lower unit 9' through rotation of a handle 95, and to position the upper unit 96 with a jig or the like (not illustrated) (this mechanism is hereinafter referred to as a fore-and-aft adjustment mechanism). Further, the machining apparatus includes a ball guide shaft (not illustrated) that is long in a lateral direction for positional adjustment of the grinding wheel 91 in the lateral direction. The wheel unit 90 is moved along the ball guide shaft by an air cylinder (not illustrated). Thus, the machining apparatus includes a mechanism configured to move the wheel unit 90 (grinding wheel 91) in the lateral direction relative to the base 94, and to position the wheel unit 90 (grinding wheel 91) with a jig or the like (not illustrated) (hereinafter referred to as a lateral adjustment mechanism).

The end face 98 of the tapered roller 99 is finished into a shape conforming to a spherical surface having a predetermined curvature radius. When the curvature radius of the end face 98 is changed due to, for example, a change of the part number of the tapered roller 99, the wheel unit 90 is swiveled about the swivel center line C0 to change the direction of the grinding wheel 91 with respect to the tapered roller 99 (see FIG. 7). FIG. 8 is a plan view for describing the grinding wheel 91 and the tapered roller 99. In FIG. 8, the grinding wheel 91 indicated by a long dashed double-short dashed line is in a reference state in which the center line Ca of the grinding wheel 91 coincides with the lateral direction. The grinding wheel 91 indicated by a continuous line is in a state in which the wheel unit 90 in the reference state is swiveled about the swivel center line C0 by an angle A.

When the curvature radius of the end face 98 of the tapered roller 99 is changed as described above, the direction (angle) of the grinding wheel 91 needs to be adjusted in accordance with the change of the curvature radius. For example, as illustrated in FIG. 8, the wheel unit 90 is swiveled about the swivel center line C0 by the angle A. Then, a machining point P0 on the end face 98 of the tapered roller 99 that is the reference of machining and the grinding wheel 91 (indicated by the continuous line) are misaligned in the lateral direction and in the fore-and-aft direction because the swivel center line C0 is located at the central part of the wheel unit 90. In order to align the grinding wheel 91 with the machining point P0, the related-art machining apparatus needs to adjust the position of the wheel unit 90 by moving the wheel unit 90 in the lateral direction with the lateral adjustment mechanism, and also to adjust the position of the wheel unit 90 by moving the wheel unit 90 in the fore-and-aft direction with the fore-and-aft adjustment mechanism.

As described above, in the related-art machining apparatus, the swivel center line C0 of the wheel unit 90 is located at the central part of the wheel unit 90. Therefore, when the direction of the grinding wheel 91 is changed, the position of the wheel unit 90 (grinding wheel 91) needs to be adjusted again both in the fore-and-aft direction and in the lateral direction. For this reason, the machining is stopped, and therefore the production efficiency decreases. Both of the fore-and-aft adjustment mechanism and the lateral adjustment mechanism are necessary for this positional adjustment. This makes the machining apparatus complicated.

SUMMARY OF THE INVENTION

It is one object of the present invention to provide a machining apparatus in which a decrease in production efficiency can be suppressed and the structure is simplified.

A machining apparatus according to one aspect of the present invention is configured to machine a machining target face of a workpiece with a grinding wheel. The machining apparatus has the following features in its structure. That is, the machining apparatus includes a support mechanism, a wheel unit, and a base. The support mechanism is configured to support the workpiece. The grinding wheel is mounted on the wheel unit. The base is configured to support the wheel unit so that the wheel unit is swivelable about a center line in a vertical direction. A machining point where the grinding wheel is brought into contact with the machining target face of the workpiece supported by the support mechanism is located on an extension of the center line serving as a swivel center of the wheel unit.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
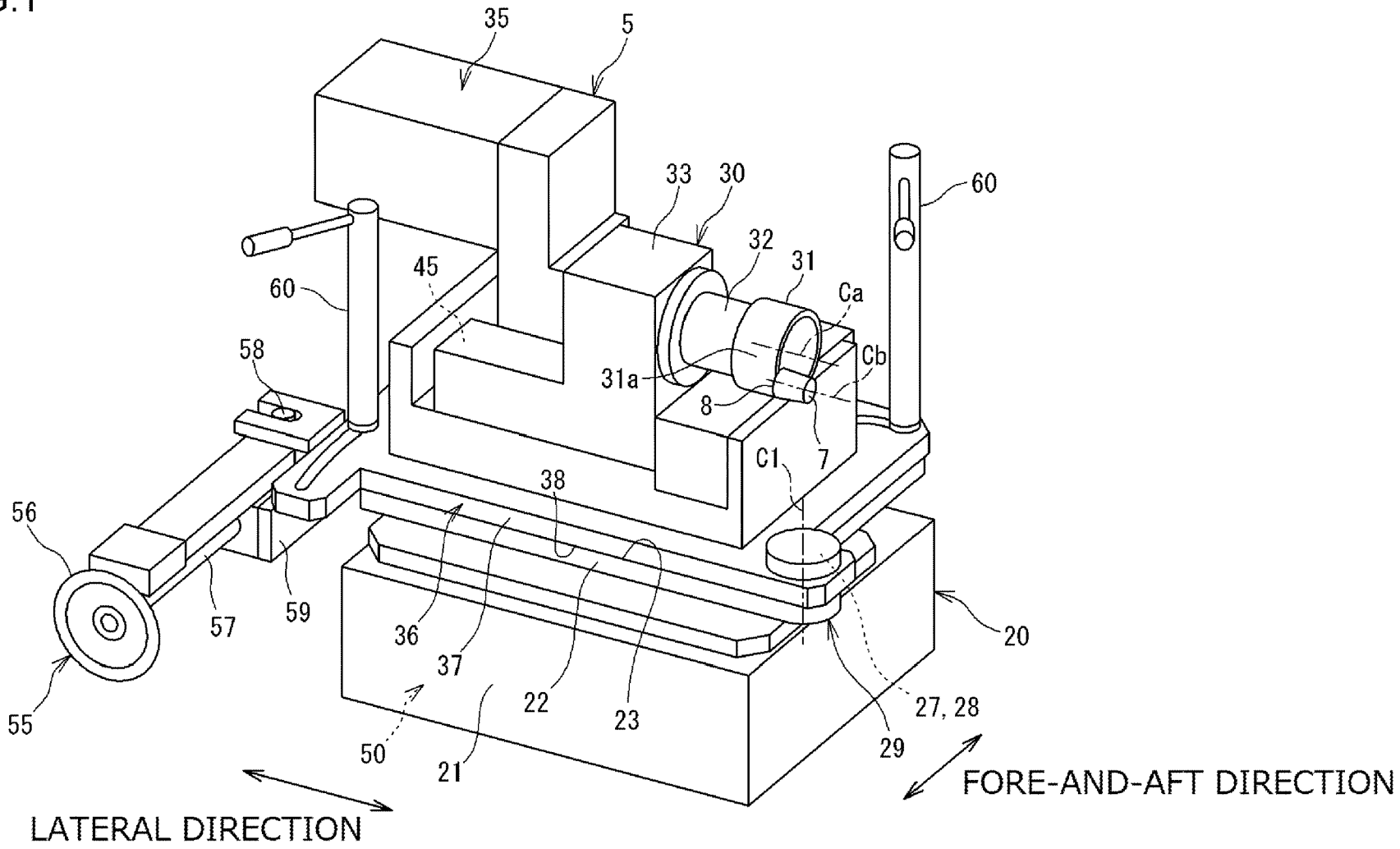
FIG. 1 is a perspective view illustrating a part of a machining apparatus according to one embodiment of the present invention.

FIG. 1 is a perspective view illustrating a part of a machining apparatus according to one embodiment of the present invention. A machining apparatus 5 of this embodiment is an apparatus configured to machine a machining target face of a workpiece with a grinding wheel 31. The workpiece of this embodiment is a tapered roller 7 to be used as a rolling element of a tapered roller bearing. The machining target face is an end face 8 of the tapered roller 7. The end face 8 is an end face having a larger diameter, and is a face to be brought into contact with a cone back face rib (large rib) of an inner ring of the tapered roller bearing. The machining apparatus 5 illustrated in FIG. 1 functions as a lapping apparatus, which performs lapping as finishing for the end face 8.

Figure 2:
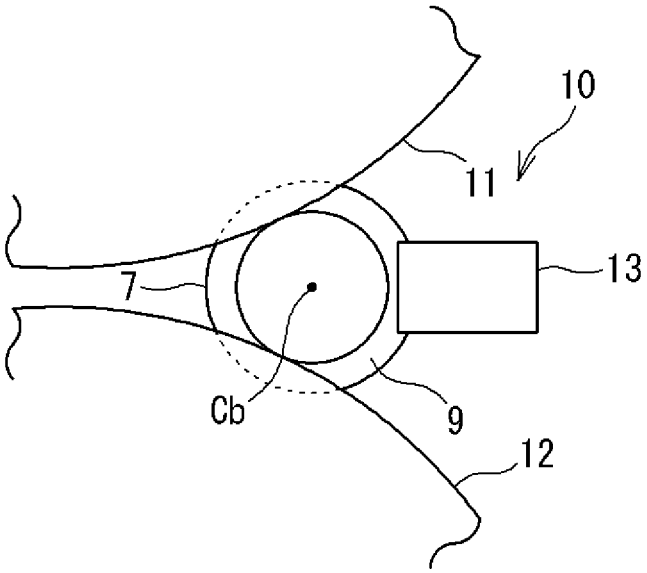
FIG. 2 is an explanatory view of a support mechanism.

The machining apparatus 5 includes a support mechanism 10 (see FIG. 2), a wheel unit 30, and a base 20. The support mechanism 10 supports the tapered roller 7. The grinding wheel 31 is mounted on the wheel unit 30. FIG. 2 is an explanatory view of the support mechanism 10. The support mechanism 10 of this embodiment includes two rolls (regulating wheels) 11 and 12 and a support member 13. The pair of rolls 11 and 12 sandwich the tapered roller 7 from above and below, and the support member 13 is brought into sliding contact with the tapered roller 7. The rolls 11 and 12 are in contact with an outer peripheral surface 9 of the tapered roller 7. When the rolls 11 and 12 rotate, the tapered roller 7 rotates about a center line Cb of the tapered roller 7. In the support mechanism 10, the tapered roller 7 is positioned in a radial direction and also in an axial direction with respect to the center line Cb. Since the tapered roller 7 is supported while being positioned, the tapered roller 7 (end face 8) is a reference of machining.

In the machining apparatus 5 (see FIG. 1), a direction of the center line Cb of the tapered roller 7 supported by the support mechanism 10 is defined as a lateral direction. The direction of the center line Cb (lateral direction) of this embodiment is a horizontal direction. A horizontal direction orthogonal to the lateral direction is defined as a fore-and-aft direction. The support mechanism 10 may have a structure other than the illustrated structure. The support mechanism 10 is mounted on an apparatus body (not illustrated) fixed to a work area.

The wheel unit 30 includes the grinding wheel 31, a spindle 32, a holder 33, and a motor (motor equipped with a speed reducer) 35. The grinding wheel 31 is attached to the spindle 32. The holder 33 rotatably supports the spindle 32. Rotation of the motor 35 is transmitted to the spindle 32, and the grinding wheel 31 rotates about a center line Ca of the grinding wheel 31 through the rotation of the motor 35. The grinding wheel 31 of this embodiment has a cup shape (bottomed cylindrical shape), and includes a cylindrical portion 31*a* to be brought into contact with the end face 8 of the tapered roller 7. The holder 33 is provided on a support table 36 of the wheel unit 30. The support table 36 includes a first plate portion 37 having a flat-plate shape. A lower face 38 of the first plate portion 37 is a leveled and smooth face.

The wheel unit 30 having the structure described above is provided on the base 20. That is, the base 20 supports the wheel unit 30 from below. The base 20 is mounted on the apparatus body (not illustrated) fixed to the work area.

The base 20 includes a lower mechanism portion 21 and a second plate portion 22. The second plate portion 22 is provided on the lower mechanism portion 21. The lower mechanism portion 21 and the second plate portion 22 are provided integrally. In this embodiment, however, the second plate portion 22 is supported on the lower mechanism portion 21 so as to be movable in the fore-and-aft direction. The second plate portion 22 and the wheel unit 30 located on the second plate portion 22 can be oscillated in the fore-and-aft direction by an oscillation mechanism 50 described later. An upper face 23 of the second plate portion 22 is a leveled and smooth face. The first plate portion 37 is placed on the second plate portion 22 in a state in which the lower face 38 of the first plate portion 37 is in surface contact with the upper face 23.

Figure 3:
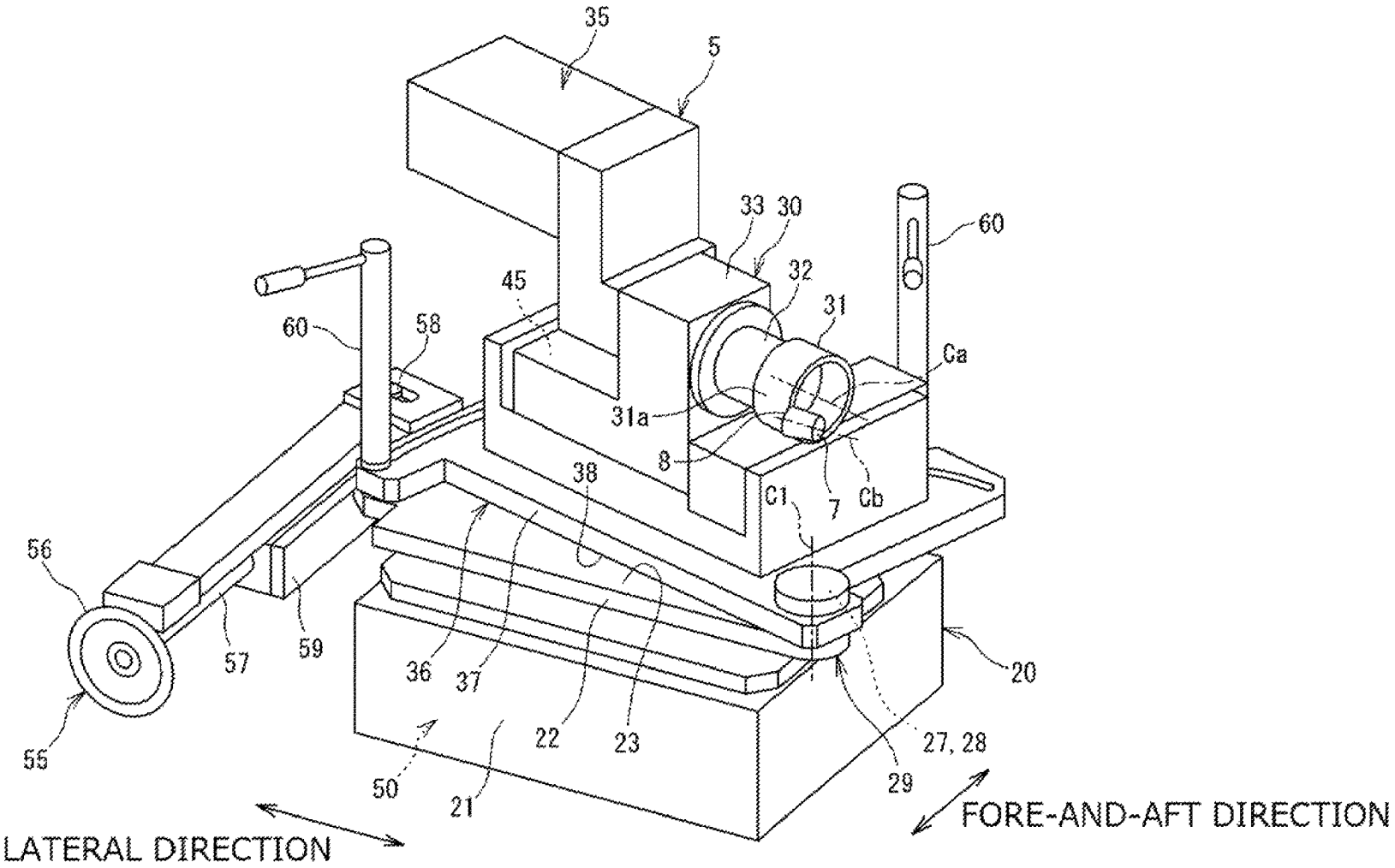
FIG. 3 is a perspective view illustrating a part of the machining apparatus.

The first plate portion 37 and the second plate portion 22 are coupled to each other by a shaft 27 having an axial center line set in a vertical direction. A coupling portion 29 that includes the shaft 27 and couples the first plate portion 37 and the second plate portion 22 to each other is provided at the ends of the first plate portion 37 and the second plate portion 22 on one side in the lateral direction (right side in FIG. 1). The shaft 27 is rotatably supported by a bearing portion (rolling bearing) 28. One of the shaft 27 and the rolling bearing 28 is provided on the first plate portion 37, and the other is provided on the second plate portion 22. The second plate portion 22 is a member on a fixed side. Thus, as illustrated in FIG. 3, the first plate portion 37 is swivelable about a center line C1 in the vertical direction relative to the second plate portion 22. When the first plate portion 37 swivels, the wheel unit. 30 swivels about the center line C1.

With the structure described above (as illustrated in FIG. 1 and FIG. 3), the base 20 including the second plate portion 22 is configured to support the wheel unit 30 including the first plate portion 37 so that the wheel unit 30 is swivelable about the center line C1 in the vertical direction. The lower face 38 of the first plate portion 37 and the upper face 23 of the second plate portion 22 are smooth faces. Thus, both the faces slide, so that the wheel unit 30 can be swiveled easily. An oil film is preferably formed between the lower face 38 of the first plate portion 37 and the upper face 23 of the second plate portion 22.

As illustrated in FIG. 3, the operation of swiveling the wheel unit 30 about the center line C1 is performed by an operation mechanism 55. The operation mechanism 55 includes a handle 56, a screw shaft 57, a support bracket 59, and a nut member 58. The handle 56 is operated by an operator. The screw shaft 57 rotates through rotation of the handle 56. The support bracket 59 rotatably supports the screw shaft 57. The nut member 58 moves along the screw shaft 57 through the rotation of the screw shaft 57. The support bracket 59 is attached to the base 20 (second plate portion 22). The support bracket 59 is constructed such that the nut member 58 is movable together with the first plate portion 37. The nut member 58 moves through the rotation of the screw shaft 57, so that the wheel unit 30 including the first plate portion 37 swivels about the center line C1. When the wheel unit 30 is swiveled to a predetermined position, the wheel unit 30 is locked by a lock mechanism 60. Thus, the wheel unit 30 is not swivelable.

The machining apparatus 5 includes the oscillation mechanism 50 for lapping. The oscillation mechanism 50 of this embodiment includes a ball screw apparatus and a linear guide (not illustrated). An axial direction of the ball screw apparatus and a guide direction of the linear guide correspond to the fore-and-aft direction. The ball screw apparatus and the linear guide are provided in the lower mechanism portion 21 of the base 20. A moving element of the ball screw apparatus reciprocally moves with a small stroke, so that the wheel unit 30 can be oscillated in the fore-and-aft direction together with the second plate portion 22. Thus, the machining apparatus 5 includes the oscillation mechanism 50 configured to linearly reciprocate the wheel unit 30 in the fore-and-aft direction.

In addition to the function of reciprocally moving the wheel unit 30 in the fore-and-aft direction with a small stroke as described above when lapping is performed on the tapered roller 7, the oscillation mechanism 50 has a function of setting the position of the wheel unit 30 by moving the wheel unit 30 in the fore-and-aft direction (to be described later). That is, the position of the wheel unit 30 can be adjusted by moving the wheel unit 30 in the fore-and-aft direction with an increased movement stroke of the moving element of the ball screw apparatus. The moving element is movable together with the second plate portion 22. The movement of the wheel unit 30 that is performed by the oscillation mechanism 50 is numerically controlled. Thus, the positional setting of the wheel unit 30 can be automated.

In a preparatory state in which the tapered roller 7 is moved to and from a machining position on the support mechanism 10 before and after the machining is performed by the grinding wheel 31, the grinding wheel 31 is retreated to a retreat position. The retreat position is a position where the grinding wheel 31 is moved to one side in the lateral direction (left side in FIG. 3). The machining apparatus 5 includes a mechanism configured to slide the grinding wheel 31 in the lateral direction (between the retreat position and the machining position) (this mechanism is referred to as a lateral movement mechanism 45). The lateral movement mechanism 45 has a function of restricting movement of the grinding wheel 31 in the lateral direction (that is, a function of locking the grinding wheel 31 at the machining position), and a function of pressing the grinding wheel 31 against the end face 8 of the tapered roller 7.

Figure 4:
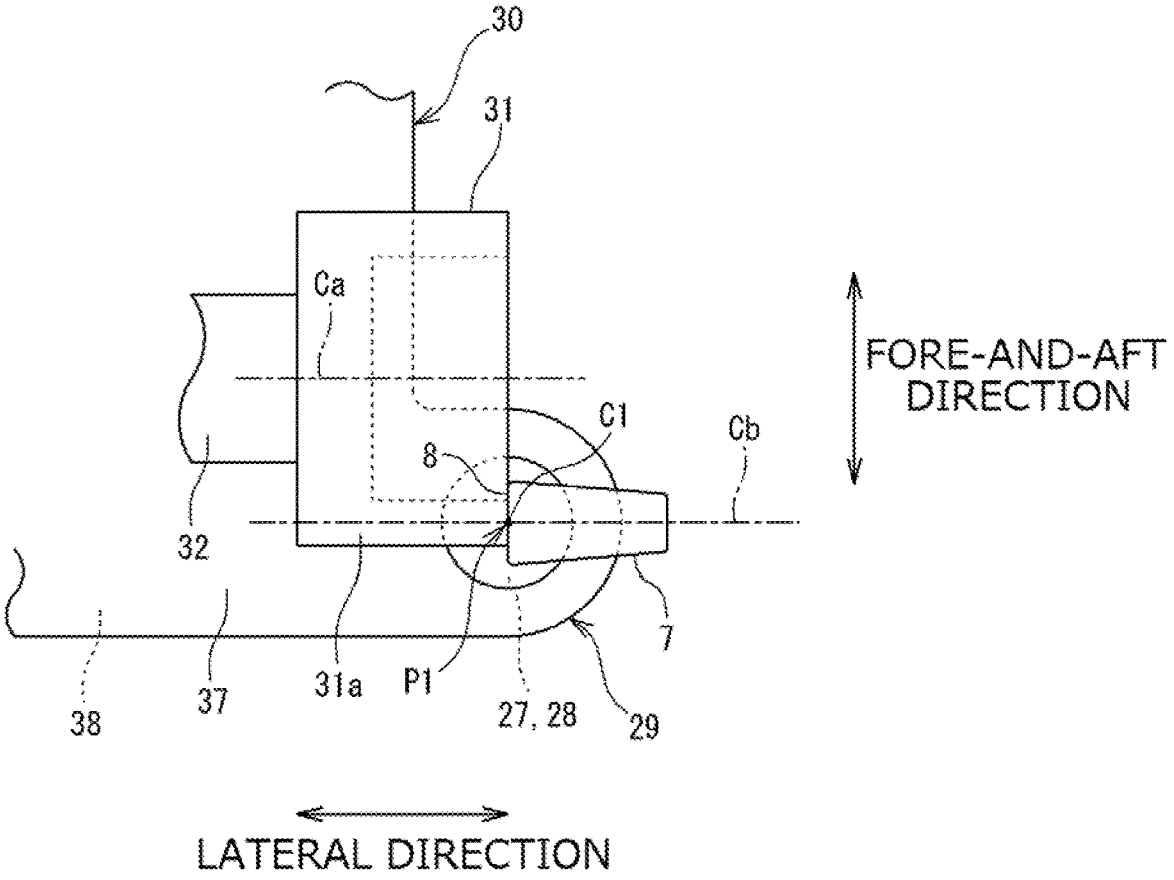
FIG. 4 is a plan view illustrating a part of the machining apparatus illustrated in FIG. 1.
Figure 5:
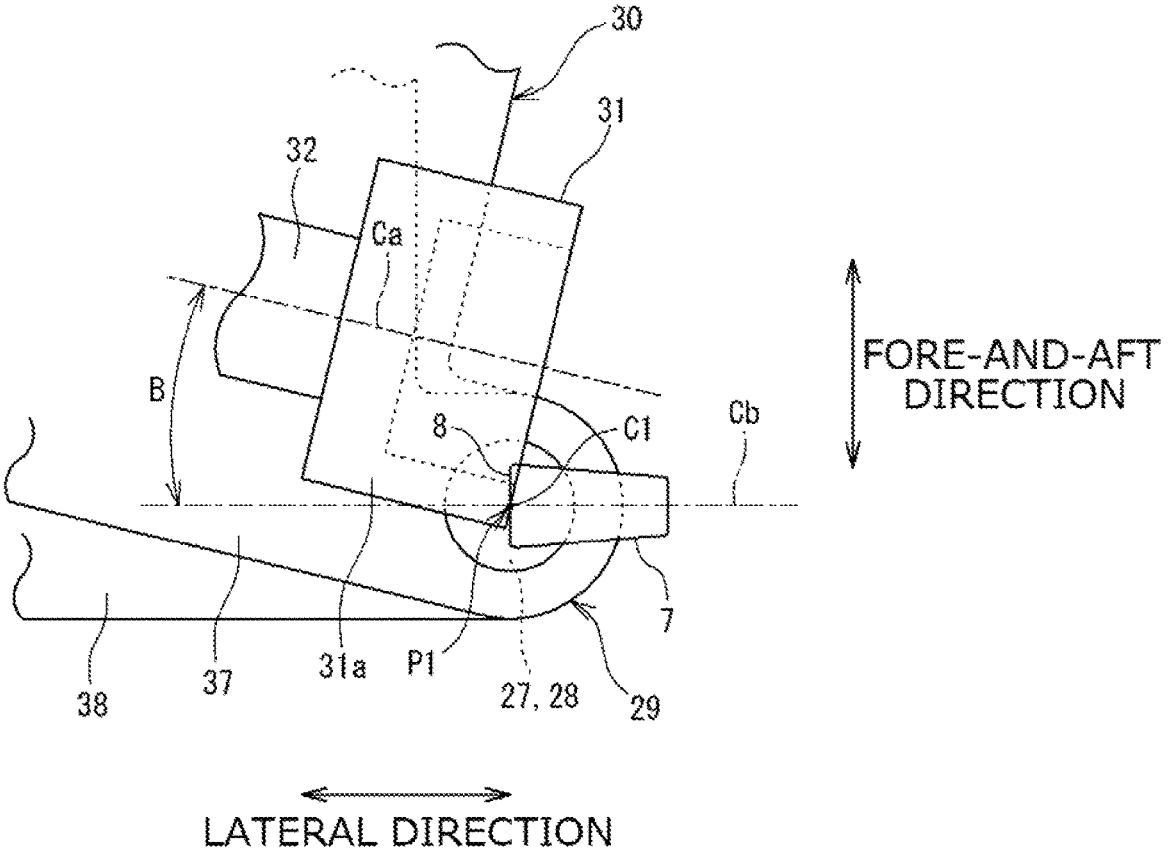
FIG. 5 is a plan view illustrating a part of the machining apparatus illustrated in FIG.
Figure 6:
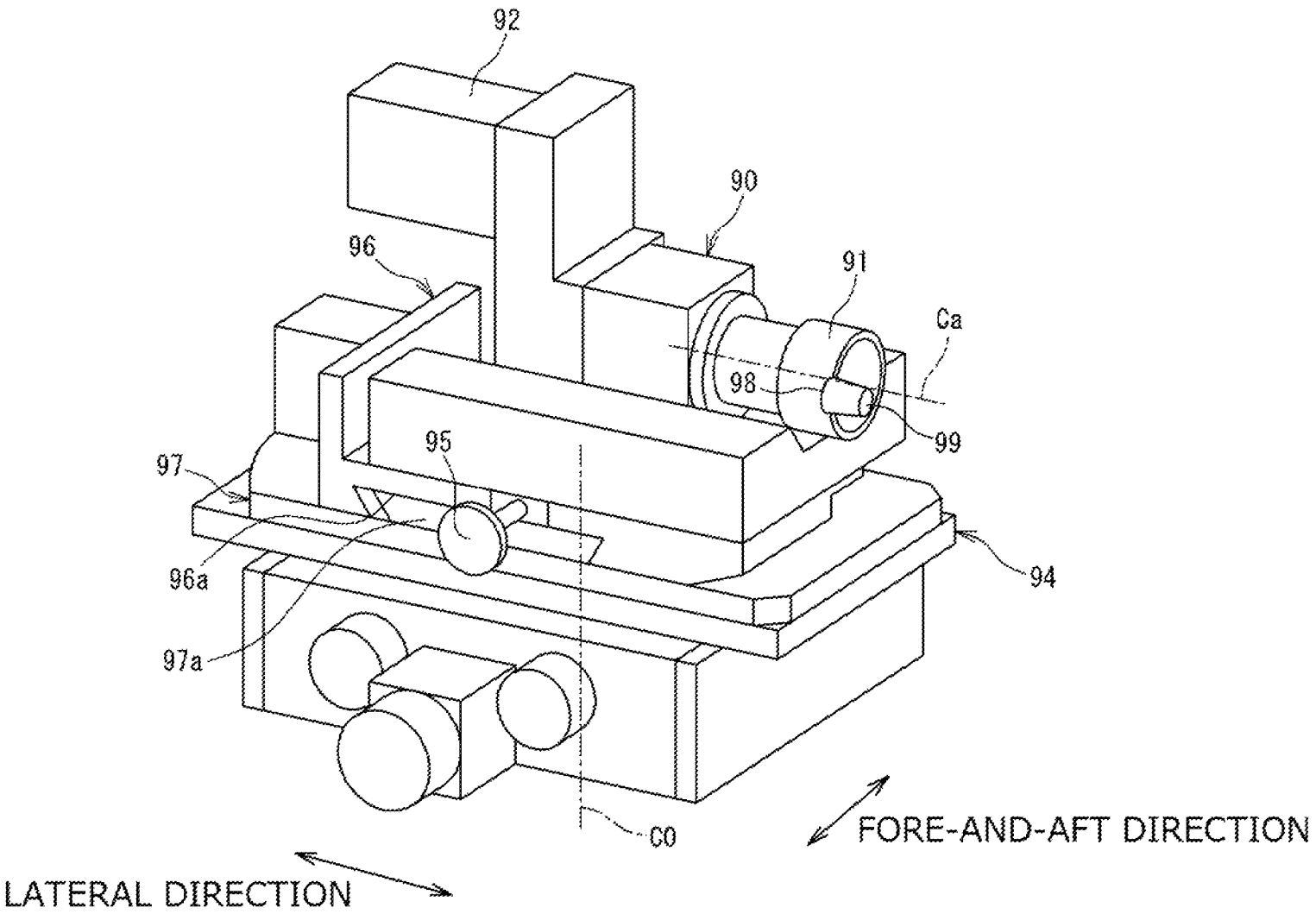
FIG. 6 is a perspective view illustrating a part of a related-art machining apparatus.

FIG. 4 and FIG. 5 are plan views illustrating a part of the machining apparatus 5 illustrated in FIG. 1 and FIG. 3, respectively. FIG. 1 illustrates a state in which the center line Ca of the grinding wheel 31 coincides with the lateral direction. This state is defined as a reference state. FIG. 3 illustrates a state in which the wheel unit 30 in the reference state is swiveled clockwise in plan view about the center line C1 by a predetermined angle. FIG. 4 is a plan view of the reference state. FIG. 5 is a plan view of the state in which the wheel unit 30 is swiveled (state of FIG. 3).

As illustrated in FIG. 5, the grinding wheel 31 machines the end face 8 of the tapered roller 7 in contact with the end face 8. As described above, the grinding wheel 31 of this embodiment has the cup shape, and includes the cylindrical portion 31*a* to be brought into contact with the end face 8. The end face 8 is finished into a shape conforming to a spherical surface having a predetermined curvature radius. Therefore, the distal end face of the cylindrical portion 31*a* has a shape conforming to the target shape. The distal end face of the cylindrical portion 31*a* is partially brought into contact with the end face 8 of the tapered roller 7. Since the grinding wheel 31 has the cup shape, the grinding wheel 31 is easily aligned with a machining point P1.

The tapered roller 7 is positioned by the support mechanism 10 (see FIG. 2). The rotating grinding wheel 31 is brought into contact with the end face 8 of the rotating tapered roller 7, and is reciprocally moved by the oscillation mechanism 50. The center of an area where the grinding wheel 31 is brought into contact with the end face 8 is the machining point P1. The oscillation mechanism 50 performs the reciprocal movement in the fore-and-aft direction with the machining point P1 set as the center.

The reference symbol "C1" in FIG. 4 and FIG. 5 represents the center line serving as a swivel center of the wheel unit 30. As illustrated in FIG. 4 and FIG. 5 (and also in FIG. 1 and FIG. 3), the machining point P1 where the grinding wheel 31 is brought into contact with the end face 8 of the tapered roller 7 supported by the support mechanism 10 (see FIG. 2) is located on an extension of the center line C1 serving as the swivel center of the wheel unit 30. As described above, in the preparatory state in which the tapered roller 7 is moved to and from the machining position on the support mechanism 10, the grinding wheel 31 is retreated to the retreat position by the lateral movement mechanism 45 (see FIG. 3). The grinding wheel 31 is kept out of contact with the end face 8 of the tapered roller 7. When the grinding wheel 31 is moved to the machining position, the machining point P1 is located on the extension of the center line C1 serving as the swivel center of the wheel unit 30. At the machining point P1, the grinding wheel 31 is brought into contact with the end face 8.

Figure 7:
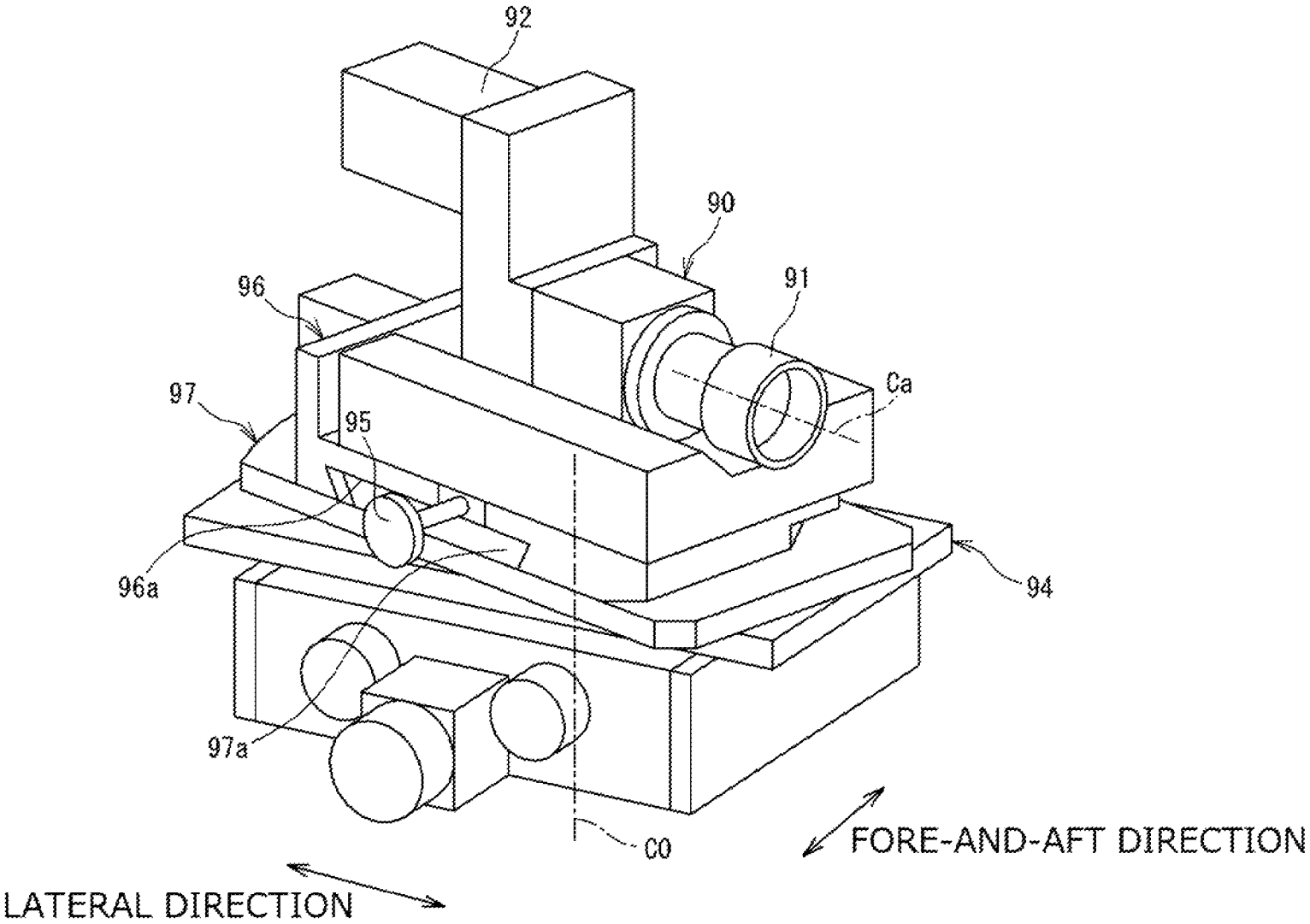
FIG. 7 is a perspective view illustrating a part of the related-art machining apparatus.
Figure 8:
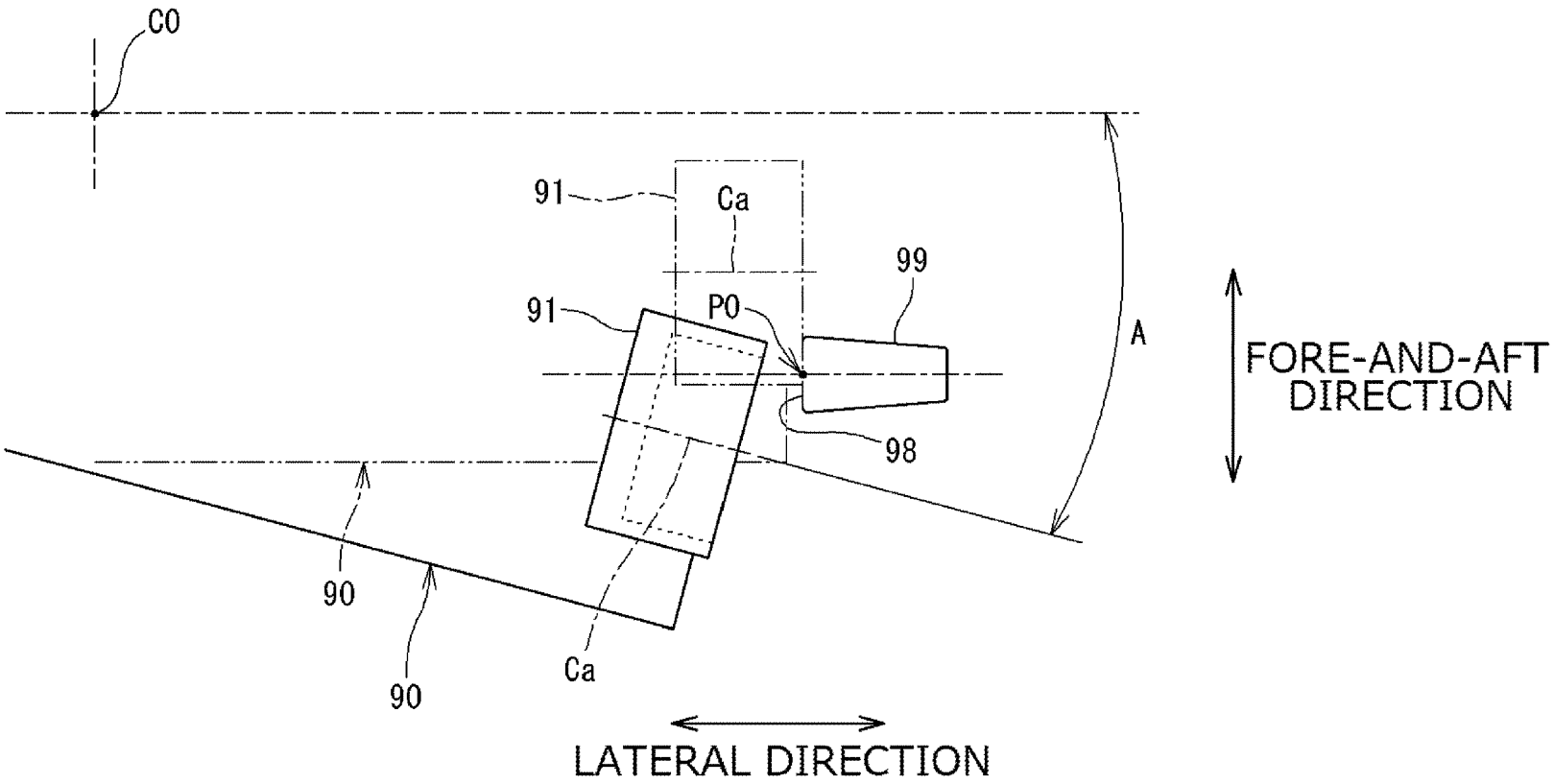
FIG. 8 is a plan view for describing a grinding wheel and a tapered roller in the related-art machining apparatus.

In the machining apparatus 5 having the structure described above, when the part number of the tapered roller 7 or the curvature radius of the end face 8 of the tapered roller 7 is changed, the angle of the grinding wheel 31 needs to be changed. In plan view (see FIG. 5), this angle is an angle B formed between the center line Cb of the tapered roller 7 and the center line Ca of the grinding wheel 31. Even when the angle of the grinding wheel 31 is changed as described above, in the machining apparatus 5 of this embodiment, the machining point P1 is located on the extension of the swivel center of the wheel unit 30 (center line C1). Therefore, even when the angle of the grinding wheel 31 is changed, misalignment in the lateral direction and in the fore-and-aft direction between the machining point P1 and the grinding wheel 31 is (substantially) zero. Thus, it is possible to save time and effort for positional adjustment of the wheel unit 30 in the fore-and-aft direction and in the lateral direction, and to therefore suppress a decrease in production efficiency. As a result, it is possible to omit the fore-and-aft adjustment mechanism and the lateral adjustment mechanism for positional adjustment, which are necessary in the related art (see FIG. 7). Accordingly, the structure of the machining apparatus 5 is simplified.

In the machining apparatus 5 of this embodiment, the size (diameter) of the grinding wheel 31 may be changed in accordance with the change of the part number of the tapered roller 7. In this case, the position of the wheel unit 30 needs to be set by moving the wheel unit 30 in the fore-and-aft direction. For example, when the diameter (cup diameter) of the grinding wheel 31 is set smaller, the wheel unit 30 needs to be moved downward in FIG. 4 and FIG. 5 in order to align the grinding wheel 31 with the machining point P1. The machining apparatus 5 of this embodiment includes the oscillation mechanism 50 as a component for lapping. This oscillation mechanism 50 is used for setting the position of the wheel unit 30 in the fore-and-aft direction along with the change of the size of the grinding wheel 31. Therefore, even when the size of the grinding wheel 31 needs to be changed, there is no need to additionally provide the fore-and-aft adjustment mechanism as in the related art (see FIG. 7). Accordingly, the machining apparatus 5 is simplified.

The embodiment disclosed above is illustrative but is not limitative in all respects. That is, the machining apparatus of the present invention is not limited to the illustrated embodiment, and other embodiments may be employed within the scope of the present invention. For example, the embodiment described above is directed to the case where lapping is performed. Alternatively, the machining apparatus of the present invention may be an apparatus configured to perform grinding. The workpiece to be machined may be a workpiece other than the tapered roller. The support mechanism 10 only needs to position and hold the tapered roller 7, and may have a structure other than the structure including the two upper and lower rolls 11 and 12 and the single support member 13 as illustrated in FIG. 2.

According to the machining apparatus of the present invention, it is possible to save time and effort for positional adjustment of the wheel unit in the fore-and-aft direction and in the lateral direction even when the angle of the grinding wheel is changed. This makes it possible to suppress a decrease in production efficiency, and to omit the mechanism for the positional adjustment. As a result, the structure of the machining apparatus is simplified.

What is claimed is:

1. A machining apparatus configured to machine a end face of a tapered roller with a grinding wheel, the machining apparatus comprising:

a support mechanism configured to rotatably support the tapered roller;

a wheel unit on which the grinding wheel is mounted;

a base configured to support the wheel unit so that the wheel unit is swivelable with respect to the base about a center line extending in a vertical direction; and an oscillation mechanism configured to reciprocate the wheel unit in a fore-and-aft direction, wherein the machining apparatus is configured so that the wheel unit swivels against the base around the center line and then the wheel unit is locked against the base, when an angle is formed between a center line of the tapered roller and a center line of the grinding wheel, a machining point where the grinding wheel is brought into contact with the end face of the tapered roller supported by the support mechanism is located on an extension of the center line serving as a swivel center of the wheel unit;

the oscillation mechanism is configured to move the grinding wheel reciprocally in the fore-and-aft direction, which is orthogonal to the center line of the tapered roller, while the grinding wheel is in contact with the end face of the tapered roller;

the support mechanism includes two rolls and a support member;

the pair of rolls sandwich the tapered roller from above and below; and the support member is configured to be brought into sliding contact with the tapered roller.

2. The machining apparatus according to claim 1, wherein the grinding wheel has a cup shape with a cylindrical portion to be brought into contact with the end face of the tapered roller.

3. The machining apparatus according to claim 1, wherein the base comprises a lower mechanism portion and a plate portion that is supported on the lower mechanism portion so as to be movable with respect to the lower mechanism portion in the fore-and-aft direction.

4. The machining apparatus according to claim 2, wherein the cylindrical portion has a distal end face that is configured to be partially in contact with the end face of the tapered roller.

5. The machining apparatus according to claim 1, wherein the oscillation mechanism is also configured to set a position of the wheel unit in the fore-and-aft direction.

* * * * *